United States Patent [19]

Bakke

[11] Patent Number: 4,815,991

[45] Date of Patent: Mar. 28, 1989

[54] ELECTRICAL CONNECTOR

[76] Inventor: John S. Bakke, 1247 Lorelei Ct., Campbell, Calif. 95008

[21] Appl. No.: 922,483

[22] Filed: Oct. 22, 1986

Related U.S. Application Data

[63] Continuation-in-part of Ser. No. 734,016, May 14, 1985, abandoned.

[51] Int. Cl.[4] ..... H01R 11/00

[52] U.S. Cl. ..... 439/502; 439/217; 439/759; 439/825

[58] Field of Search ..... 339/32 R, 32 M, 28, 339/29 R, 29 B, 252 S, 252 P, 258 R, 224, 228, 225; 439/502–504, 506, 217, 222, 223, 825, 826, 759

[56] References Cited

U.S. PATENT DOCUMENTS

| | | | |
|---|---|---|---|
| 3,605,066 | 9/1971 | Vierck, Sr. et al. | 339/32 R |
| 4,120,557 | 10/1978 | Horrocks | 339/258 R |
| 4,468,083 | 8/1984 | Lee et al. | 339/252 R |

*Primary Examiner*—Gil Weidenfeld
*Assistant Examiner*—Paula A. Austin
*Attorney, Agent, or Firm*—Townsend & Townsend

[57] ABSTRACT

A device for making electrical connection in which the device can serve either as a clip or a plug. The device includes a pair of pivotally interconnected jaws which can open and be clipped onto a wire or electrical terminal, the jaws being biased toward each other. In one embodiment, each jaw is provided near its outer surface with an electrically conductive member defined by one or more resilient electrical contact elements which extend longitudinally of the corresponding jaw. The elements of each member are integral with a pair of semicircular bands which are secured in any suitable manner, such as by soldering or spot welding, to the outer surface of the respective jaw. When the jaws are closed, the members mate with each other at the side edges to form a banana plug which can be inserted into a jack or other tubular recess. In another embodiment, the jaws have integral contact elements thereon which define a banana plug configuration when the jaws are closed. The connector is provided with a tubular extension on one of the jaws thereof for use as a jack to receive the plug formed by the jaws and members of a second, substantially identical connector or a conventional banana plug whereby two or more connectors can be ganged for electrical interconnection.

5 Claims, 2 Drawing Sheets

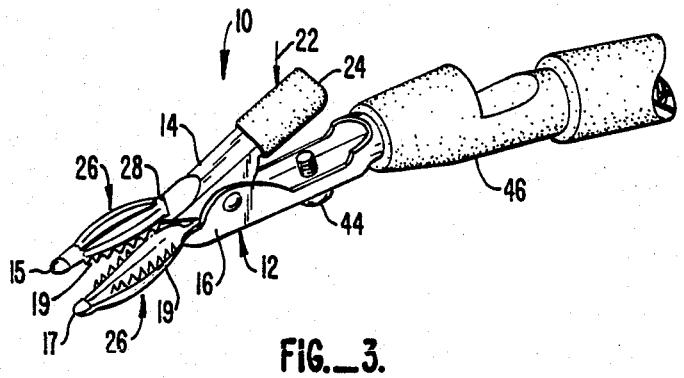
FIG._3.
FIG._4.
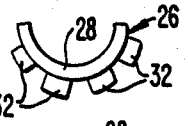
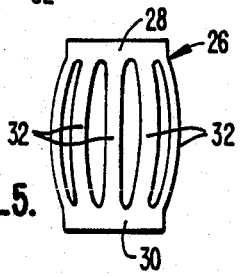
FIG._5.
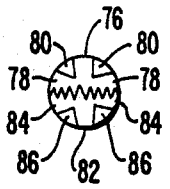
FIG._7.
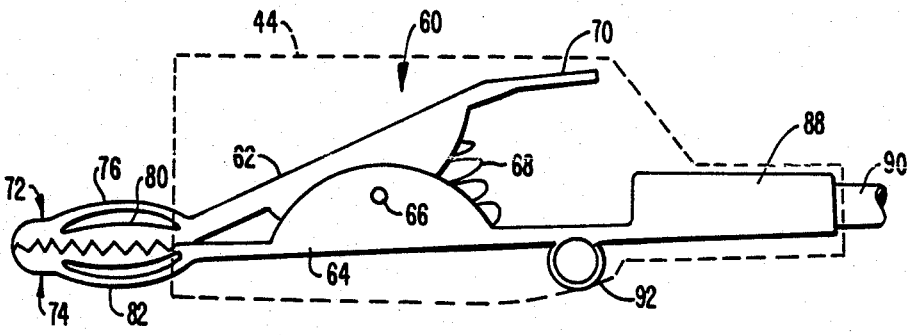
FIG._6.

ELECTRICAL CONNECTOR

This application is a continuation-in-part patent application of application Ser. No. 734,106 now abandoned.

This invention relates to improvements in electrical connectors and, more particularly, to such a connector which can be used in several different modes of operation.

BACKGROUND OF THE INVENTION

Alligator clips and banana plugs are well-known as electrical connectors. Both of these types of electrical connectors can be used only in a single mode. The alligator clip can only be used in a manner such that its jaws, when open, can embrace and become clipped to a wire, electrical terminal or other electrical component. A banana plug can only be used for insertion into a jack or other recess especially adapted for receiving it. A banana plug cannot be used like an alligator clip, and an alligator clip cannot be used like a banana plug with a jack or other device with a recess. To try to insert a jaw of an alligator clip into a jack, for instance, would provide a faulty connection and could even cause damage to a circuit associated with the alligator clip.

Because of these drawbacks and because of a need for more versatility in making electrical connections with clips and plugs, a need exists for improvements in connectors which provides the benefits of both an alligator clip and a banana plug. The present invention satisfies this need.

SUMMARY OF THE INVENTION

The present invention is directed to an improved electrical connector which has a pair of pivotally interconnected jaws, with a spring biasing the jaws toward each other. In one embodiment, each jaw has an improved electrical member thereon, and such members, when the jaws are closed, cooperate with each other to present a banana plug configuration for the connector yet the members allow the jaws to embrace and to clip onto a wire, an electrical terminal or other electrical component. In another embodiment the jaws comprise integral spring members which form a banana plug when the jaws are closed.

In the first embodiment each member is formed from a pair of spaced, semi-circular end bands having curved, resilient electrical contact elements which span the distance between the bands and are integral therewith. The electrical contact elements bow outwardly as they extend away from the bands to present convex outer surfaces suitable for electrically engaging the inner surface of a jack or other tubular electrical device. When the jaws are closed, the adjacent side edges of the members are contiguous to each other so that, in effect, the two members define a banana plug even though the members are separable from each other and are carried independently of each other on respective jaws of the connector.

The connector of the present invention is provided with a tubular part extending away from one of the jaws. The tubular part defines a jack for receiving the jaws and electrical contact members of a second, substantially identical connector when the jaws of the second member are closed. In the alternative, the tubular part or jack of the connector can receive a conventional banana plug; thus, the connector of this invention and additional such connectors and/or banana plugs can be ganged to provide multiple electrical connections quickly and easily yet the connectors ganged together can be separated and used as alligator clips for attachment to circuit components, such as wires, electrical terminals, binding posts and the like.

The primary object of the present invention is to provide an improved electrical connector which can operate in two different modes, namely as a clip or as a banana plug yet the connector is simple and rugged in construction, is inexpensive to produce and maintain and is suitable for a wide variety of applications for making electrical connections.

Other objects of this invention will become apparent as the following specification progresses, reference being had to the accompanying drawings for an illustration of several embodiments of the invention.

IN THE DRAWINGS

FIG. 3 is an enlarged, perspective view of the connector of the present invention, showing the way in which the jaws of the connector are opened for attachment onto an electrical component, such as a wire, electrical terminal, binding post or the like;

FIGS. 4 and 5 are end and side elevational views of an electrical contact member for attachment to a jaw of the connector to provide a banana plus configuration therefor;

FIG. 6 is a side elevational view of a second embodiment of the present invention; and FIG. 7 is an end elevational view of the clip of FIG. 6.

Figure 1:
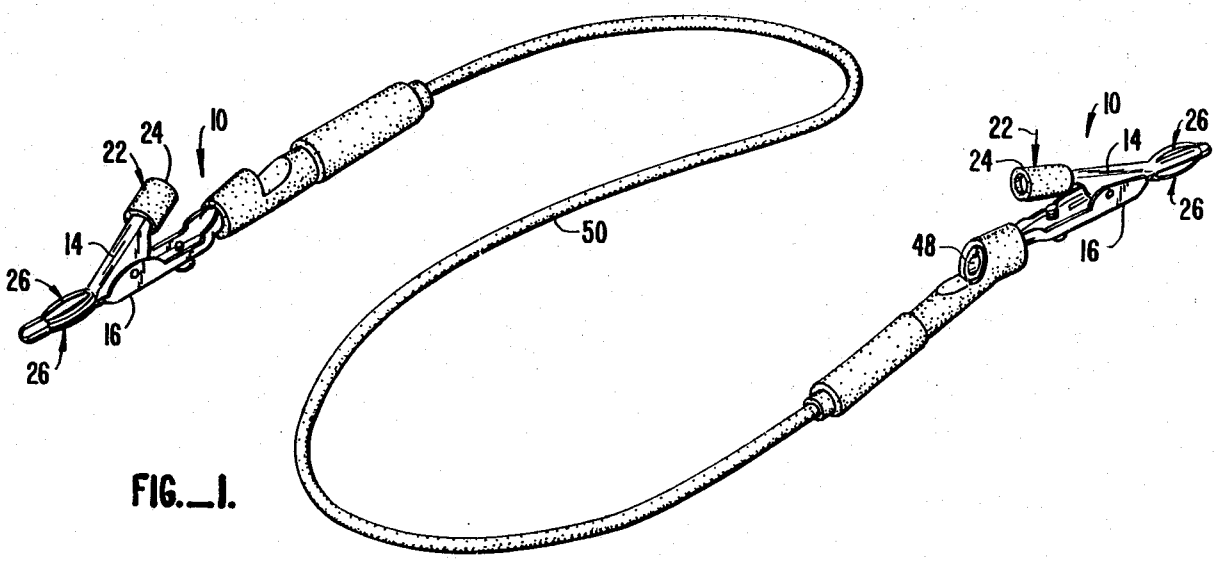
FIG. 1 is a perspective view of an assembly including a wire with one embodiment of the improved electrical connector of the present invention coupled to each end, respectively, of the wire.

The first embodiment of the connector of the present invention is broadly denoted by the numeral 10 and is in the form of a clip 12 similar in construction to an alligator clip in that it has a pair of members 14 and 16 pivotally interconnected by a pin 18 and biased toward each other by a spring 20. Members 14 and 16 have jaws 15 and 17 which open and close and, when open, the jaws are separated from each other. A pressure exerted as indicated by arrow 22 on an extension 24 of member 14 and sufficient to overcome the restoring force of spring 20 causes the jaws to open up as shown in FIG. 3. The jaws have serrations defining teeth 19 for grasping an electrical component to which the jaws are to be clipped.

Each jaw has a electrical contact member 26 secured thereto, member 26 being shown in detail in FIGS. 4 and 5. Each contact member 26 is electrically conductive and has a pair of curved or semi-circular end bands 28 and 30 adapted to be secured to the outer surface of a respective jaw. Each member 26 further includes a number of spaced outwardly bowed, resilient, electrical contact elements 32 which have generally convex outer surfaces. There can be any number of elements 32 or each member 26. For purposes of illustration, there are four such elements 32 on each member 26.

Figure 2:
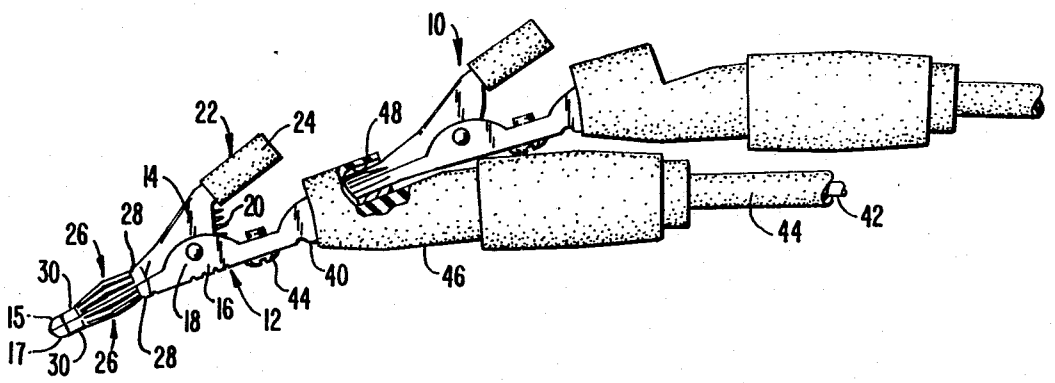
FIG. 2 is a side elevational view, partly broken away and in section, of the electrical connector of the present invention, showing the way in which a pair of such connectors can be coupled together in ganged relationship with respect to each other.

Each member 26 is secured in any suitable manner, such as by soldering or spot welding, to the respective jaw of clip 12. As shown in FIG. 2, bands 28 and 30 of each member 26 are secured to the adjacent outer surface portions of the corresponding jaw with the elements 32 extending longitudinally of the jaws and bowed outwardly therefrom so that elements 32 yield inwardly when inserted into a jack. One of the members 26 has a pair of opposed side edges which are contiguous to respective, opposite side edges of the other member 26 when the jaws are closed, as shown in FIG. 2. These contiguous side edges separate when the jaws are opened (FIG. 3). When the jaws are closed as shown in FIG. 2, members 26 on jaws 15 and 17 effectively define a banana plug which can be inserted into a jack or other tubular recess for making electrical connection between clip 12 and the jack. Thus, connector 10 can serve a dual purpose for electrical connection purposes, namely as a clip and as a plus, such as a banana plug. The connector 10 is, therefore, versatile and suitable for a wide variety of uses in electrical circuit connection and testing applications.

Clip 12 is provided with an extension 40 integral with and extending outwardly from the rear end of member 16. A wire 42 with insulation 44 thereon is coupled to extension 40 in any suitable manner, such as by a locking screw 44 threaded onto extension 40. A resilient boot 46 can extend about the rear end of extension 40 and project rearwardly therefrom about wire 42.

Extension 40 is provided with a tubular part 48 at the rear end thereof to present an open-ended recess or jack for receiving the front end or banana plug end of a second connector 10 in the manner shown in FIG. 2. Thus, any number of connectors 10 can be ganged and electrically interconnected by coupling the additional connectors 10 to the first connector as shown in FIG. 2. Moreover, the recess formed by tubular part 48 can also receive one or more conventional banana plugs for interconnecting connector 10 and the banana plugs in ganged relationship.

In use, connector 10 can be used for a number of different applications. One use of such a clip is for attachment to the ends of a wire 50 as shown in FIG. 1 to present a test lead. Such a test lead can be used to test electrical circuit components which require either a clip or a banana plug attachment.

A second embodiment of the connector of the present invention is broadly denoted by the numeral 60 and includes a pair of members 62 and 64 which are pivotally connected by a pin 66. A spring 68 biases member 62 in a counter clockwise sense in viewing FIG. 6. Member 62 has an extension 70 thereon which is pressed by the finger to open a pair of jaws 72 and 74, each jaw having serrations on the side and front margins thereof. Jaws 72 and 74 are integral with members 62 and 64, respectively. Jaw 72 has a central contact element 76 and a pair of side contact elements 78. Elements 76 and 78 are integral with each other and are separated by slots 80 as shown in FIGS. 6 and 7. Similarly, jaw 74 is provided with a central contact element 82 and a pair of side elements 84, elements 82 and 84 being integral with each other and being separated by slots 86 (FIG. 7).

While only a single central element 76 and a single central element 82 have been described, there can be more than a single such element for such jaw 72 or 74.

The outer surfaces of elements 76 and 82 are convex and they form with side elements 78 and 84 a banana plug configuration when the jaws are closed. Moreover, central elements 76 and 82 are essentially resilient so that they spring inwardly when the closed jaws of 72 and 74 are inserted into a jack, for instance. The resilience of central elements 76 and 82 thereby provide good electrical contact with the inner surface of the jack. Thus, elements 76, 78, 82 and 84 are integral with jaws 72 and 74 so as to avoid the need for contact members attached to the jaws as described above with respective connector 10.

Member 62 is provided with a tubular rear end portion 88 which can be coupled to a wire 90. In addition, member 64 can be provided with a further extension which can provide a tubular part such as tubular part 48 of connector 10. In this way, a second connector 60 can be coupled in piggy-back fashion to the first connector 60 shown in FIG. 6.

A tubular member 92 is ridigly secured to the under side of member 64 as shown in FIG. 6. member 92 has a central axis perpendicular to the longitudinal axis of connector 60. Member 92 is also electrically connected to members 64 and is adapted to receive a banana plug, such as the closed jaws of another connector 60 for electrically connecting the two connectors together. The length of pivotor member 92 can be selected as designs. Typically, the length of member 92 is .25 inch to .50 inch.

A flexible boot 94 of neoprene or rubber can be provided on connector 60 to cover the members 62 and 64 as shown in dash lines in FIG. 6. Moreover, connector 60 can be plated to provide greater electrical conductivity therefor.

I claim:

1. An electrical connector comprising:

a pair of jaws;

means pivotally interconnecting the jaws for movement toward and away from each other;

means biasing the jaws toward each other, the jaws being separable to permit an electrical component to be inserted between and in electrical contact with the jaws said jaws having means thereon to form a plug-like configuration therefor when the jaws are adjacent to each other, one of the jaws having a tubular extension thereon, the outer end of the extension being open to receive a banana-plug-type electrical connector.

2. A connector as set forth in claim 1, wherein the tubular extension is at an angle relative to the longitudinal axes of the jaws.

3. An electrical connector comprising:

a pair of jaws, each jaw being defined by a number of elongated, resilient contact elements;

means pivotally interconnecting the jaws for movement toward and away from each other; and means biasing the jaws toward each other, the jaws being separable to permit an electrical component to be inserted between and in electrical contact with the jaws, each of the jaws having at least one contact element provided with a pair of spaced ends and a convex outer surface between the ends thereof, the elements of the jaws extending longitudinally of each other and forming a plug-like configuration when the jaws are adjacent to each other.

4. An electrical connector comprising:

a pair of jaws, each jaw including a pair of side elements and a central element, the elements of each jaw being separated by a respective slot therebetween;

means pivotally interconnecting the jaws for movement toward and away from each other; and means biasing the jaws toward each other, the jaws being separable to permit an electrical component to be inserted between and in electrical contact with the jaws, the central element of each jaw having a pair of spaced ends and a convex outer surface between the ends thereof, the elements of said jaws extending longitudinally of each other and forming a plug-like configuration when the jaws are adjacent to each other.

5. A connector as set forth in claim 4, wherein the side margin of the side elements are serrated.

* * * * *